US005509590A

United States Patent [19]

Medeiros, Jr. et al.

[11] Patent Number: 5,509,590

[45] Date of Patent: Apr. 23, 1996

[54] COLLAPSIBLE BABY CARRIER DEVICE

[75] Inventors: Edmund E. Medeiros, Jr., Waimanalo, Hi.; Stan A. Sanders, Lake Elsinore, Calif.

[73] Assignee: Waco Corporation, Tokyo

[21] Appl. No.: 241,918

[22] Filed: May 12, 1994

(Under 37 CFR 1.47)

[51] Int. Cl.[6] ..... A61G 1/00

[52] U.S. Cl. ..... 224/161

[58] Field of Search ..... 224/161, 160, 224/159, 158

[56] References Cited

U.S. PATENT DOCUMENTS

| | | | |
|---|---|---|---|
| D. 204,190 | 3/1966 | Levy . | |
| D. 225,180 | 6/1980 | Raz . | |
| D. 294,429 | 3/1988 | Vasquez . | |
| 1,039,009 | 9/1912 | Averill . | |
| 2,712,404 | 7/1955 | Miller . | |
| 2,822,117 | 2/1958 | Mack | 224/161 |
| 2,854,060 | 9/1958 | Welsh . | |
| 3,009,613 | 11/1961 | Noland . | |
| 3,881,644 | 5/1975 | Demaline | 224/161 X |
| 4,271,998 | 6/1981 | Ruggiano . | |
| 4,469,259 | 9/1984 | Krick et al. . | |
| 4,941,604 | 7/1990 | Nagareda . | |
| 5,222,641 | 6/1993 | Medeiros, Jr. | 224/161 |

FOREIGN PATENT DOCUMENTS

| | | |
|---|---|---|
| 678225 | 8/1952 | United Kingdom . |

*Primary Examiner*—Renee S. Luebke
*Attorney, Agent, or Firm*—Shlesinger Arkwright & Garvey

[57] ABSTRACT

An infant carrier device adapted to be worn on the upper torso of a wearer to position the infant in front of the wearer comprising a support frame having a first end and an opposite second end, bifurcated shoulder support members extending from the support frame first end to position the carrier about the upper torso of a wearer and a seat member secured to the support frame second end to receive and support an infant or small child.

20 Claims, 6 Drawing Sheets

COLLAPSIBLE BABY CARRIER DEVICE

FIELD OF THE INVENTION

The present invention generally relates to baby or infant carriers and more specifically to baby carriers that attach to the upper body of a user and position the infant in front of the wearer while in a seated position.

BACKGROUND OF THE INVENTION

Devices for carrying and transporting infants or small children that are mounted upon the shoulders of the wearer are well known in the art. For example, U.S. Pat. No. 4,271,998 (Ruggiano) discloses an infant carrier having a pouch into which the infant is positioned. That device includes flexible shoulder straps for the wearer that position the pouch in front of the wearers body. Other prior art infant carriers employing flexible straps include U.S. Pat. No. 4,469,259 (Krich et al.) and U.S. Pat. No. 4,941,604 (Nagareda).

Although the above noted prior art devices provide the convenience of being readily collapsible and storable, they possess inherent shortcomings due to their lack of an internal support frame. For example, the absence of a rigid support results in an inordinate suspension that tends to stress the wearer about his or her shoulders and waist. Consequently, the device requires readjustment as the child shifts and moves in the seat. In addition, prior art devices lacking internal frame supports tend to collapse around the infant during use thereby contributing to excessive heat and discomfort for both the infant and the wearer.

Another problem associated with the above noted carriers as well as with other designs that position an infant in front of the wearer is the discomfort experienced by women who use the device. The straps of such devices tend to cause excessive pressure against the wearers upper body and especially against the breasts. If the device employs a rigid frame within the shoulder supports, the problem is magnified.

Although rigid frame infant carrier devices are known in the art, they often lack the convenience of being fully collapsible for storage or transport. Even if they are somewhat foldable, the frame members in such devices require a number of manipulations that are cumbersome and awkward to perform.

A need has therefore existed in the art for an up front type infant carrier having a rigid frame that provides a high degree of support yet will not cause discomfort to the wearers chest and is fully collapsible.

OBJECTS AND SUMMARY OF THE INVENTION

It is therefore an object of the present invention to provide an up front type infant carrier device which is designed to be comfortably worn by women.

It is another object of the present invention to provide an infant carrier device which employs a rigid frame for improved support and yet is completely collapsible for storage purposes.

It is still another object of the present invention to provide a new and improved carrier device for an infant or child that is capable of carrying the infant in front of and facing forward of the wearers torso for increased comfort.

It is yet another object of the present invention to provide a lightweight and comfortable infant carrier which includes an internal frame for increased support and one which can be taken on and off in an efficient manner.

It is still a further another object of the present invention to provide an infant carrier that positions the infant in front of the wearer so as to shield the infant from potential harm and falling debris and allows the infant to be kept in constant view of the wearer.

It is an object of the present invention to provide a carrier device for infants which is weather resistant, foldable and has a durable internal frame that is padded for comfort.

In summary, the present invention is directed to an infant carrier device adapted to be worn upon the upper torso of a wearer comprising a support frame having a first end and an opposite second end, a bifurcated shoulder support member extending from the support frame first end positions the carrier device about the upper torso of the wearer and a seat member secured to the support frame second end receives and supports the infant or small child in the device.

The present invention is also directed to an infant carrier device adapted to be worn on the upper torso of a wearer to position the infant in front of the wearer comprising a support frame having a generally X-shaped main body portion including a first end and an opposite second end, bifurcated shoulder support members extending from the support frame first end to enable the carrier to be positioned about the upper torso of a wearer and a seat member secured to the support frame second end to receive and support a infant or small child.

These and other objects of the present invention will become apparent from the following detailed description.

BRIEF DESCRIPTIONS OF THE DRAWINGS

DETAILED DESCRIPTION OF THE INVENTION

Figure 1:
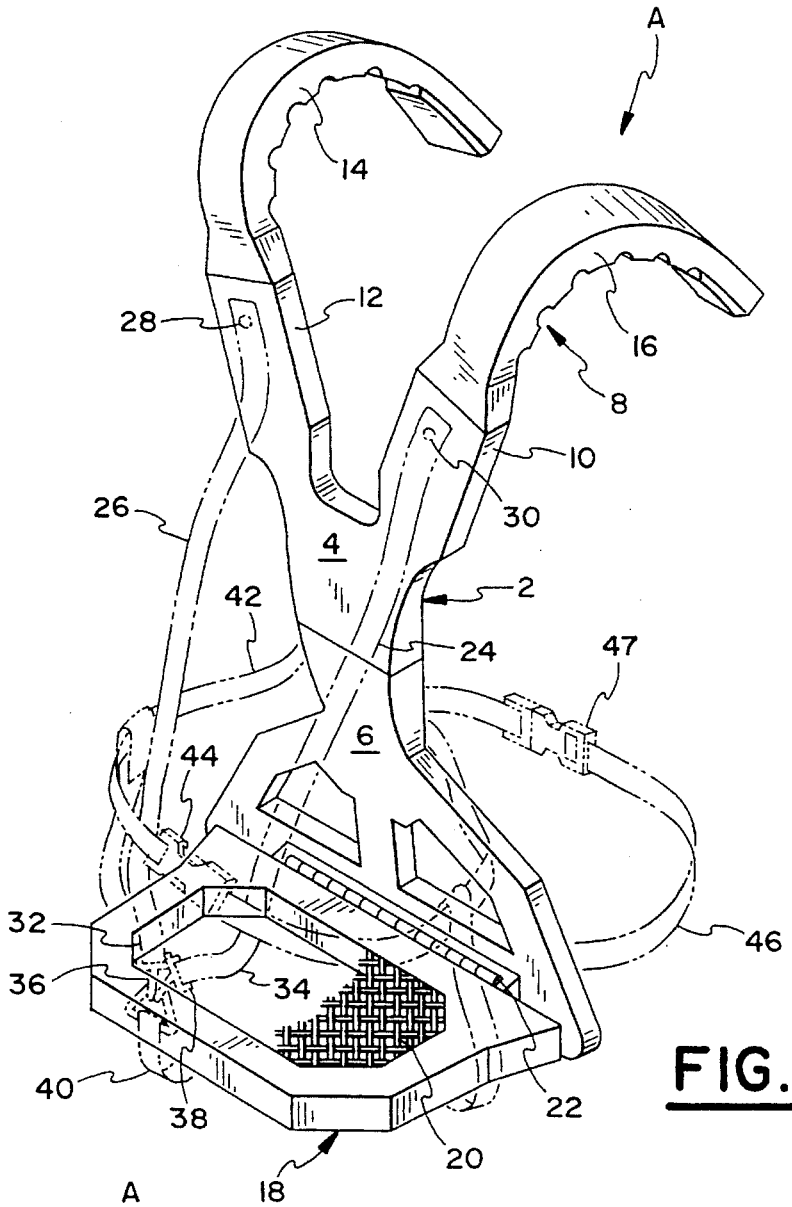
FIG. 1 illustrates a perspective view of one embodiment according to the present invention with the harness straps shown in phantom lines.

Referring to FIG. 1, the infant carrier A according to the present invention can be seen comprising a generally x-shaped support frame or body 2 including an upper first end 4 and a lower second end 6. A shoulder support member 8 is generally shown extending from the upper end 4 of the support frame 2. The shoulder support member 8 includes a pair of elongated struts 10 and 12 which together form a generally Y-shaped member. Each of the elongated struts 10 and 12 are provided with respective arcuately shaped portions 14 and 16.

The lower end 6 of support frame 2 is provided with a seat member 18 shown having a webbed portion 20 that serves as a support for a child (not shown) to be positioned within the carrier device A. Seat member 18 is hingedly secured to the lower end 6 of the support frame 2 by hinge device 22 or similar means. The seat member 18 is illustrated in FIG. 1 in an open position and extends perpendicular to the longitudinal axis of the support frame 2.

Also shown in phantom lines are shoulder harness straps 24 and 26. Each strap is separately secured at respective first ends 28 and 30 to a separate one of the respective elongated struts 12 and 10. The shoulder harness strap respective opposite ends 32 and 34 are each provided with attachment members 36 and 38 respectively comprising a fastener or similar means to allow the straps to be selectively locked into position with seat strap 40. A childs waist strap 42 is provided with a suitable locking member 44. A separate wearer's waist strap 46 including fastener 47 is also provided to assist in securing the carrier device A to the wearer as will be further explained below.

Figure 2:
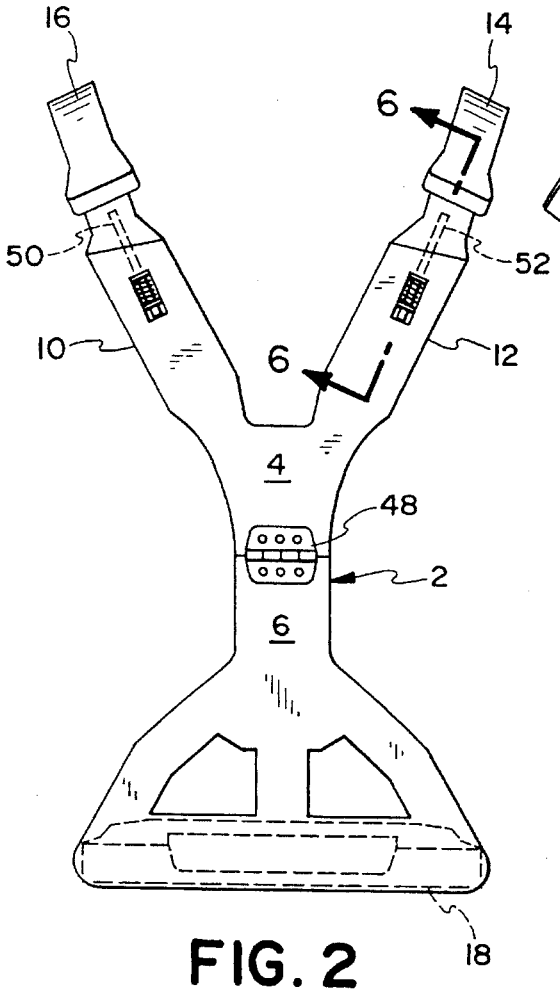
FIG. 2 illustrates a rear view of the device of FIG. 1 with portions of the rotatable pins and the seat member shown in hidden lines.
Figure 3:
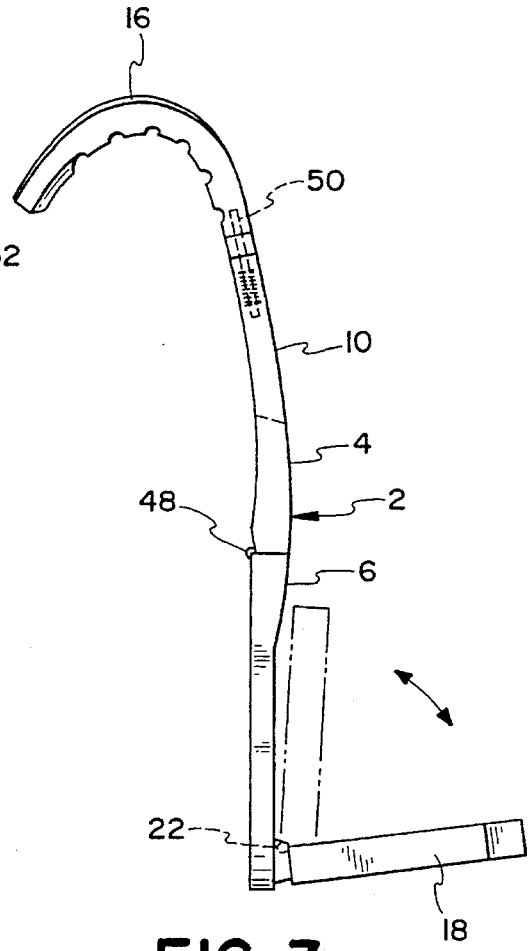
FIG. 3 illustrates a side view of the device shown in FIG. 2 and with the seat member also shown in phantom lines in a folded position and with an arrow indicating direction of such movement.

Turning now to FIGS. 2 and 3, the upper end 4 and lower end 6 are shown connected by a hinge member 48 or similar means. A spring biased rotatable pin member 50 is also shown extending within its respective end of the arcuate shaped portion 16 and end of the elongated strut 10. An identical rotatable pin 52 is also provided for the other elongated strut 12 and arcuate shaped portion 14.

Figure 5:
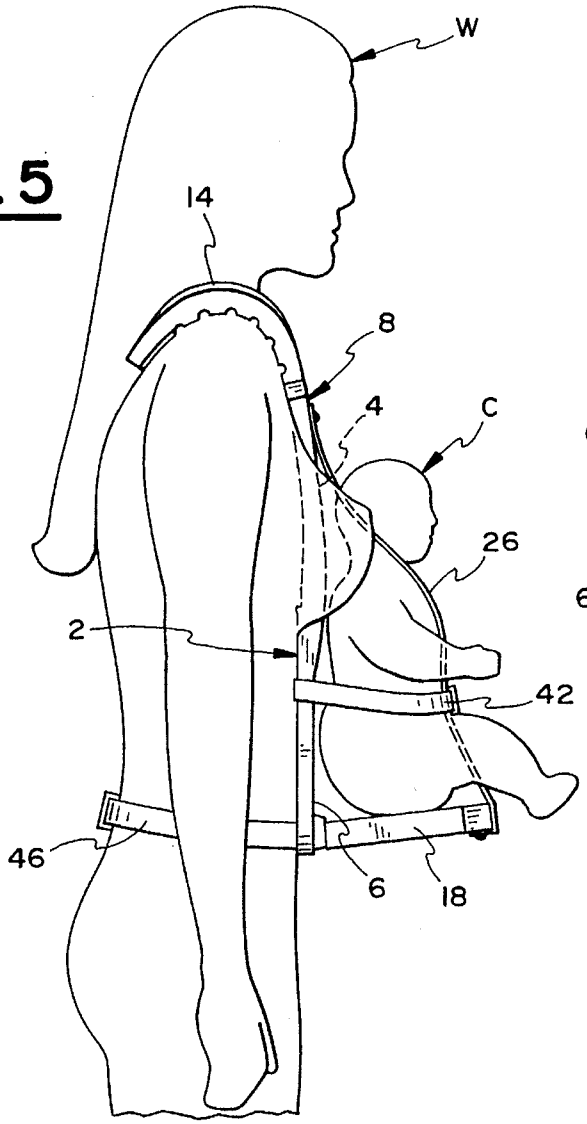
FIG. 5 illustrates a side view of FIG. 4.
Figure 4:
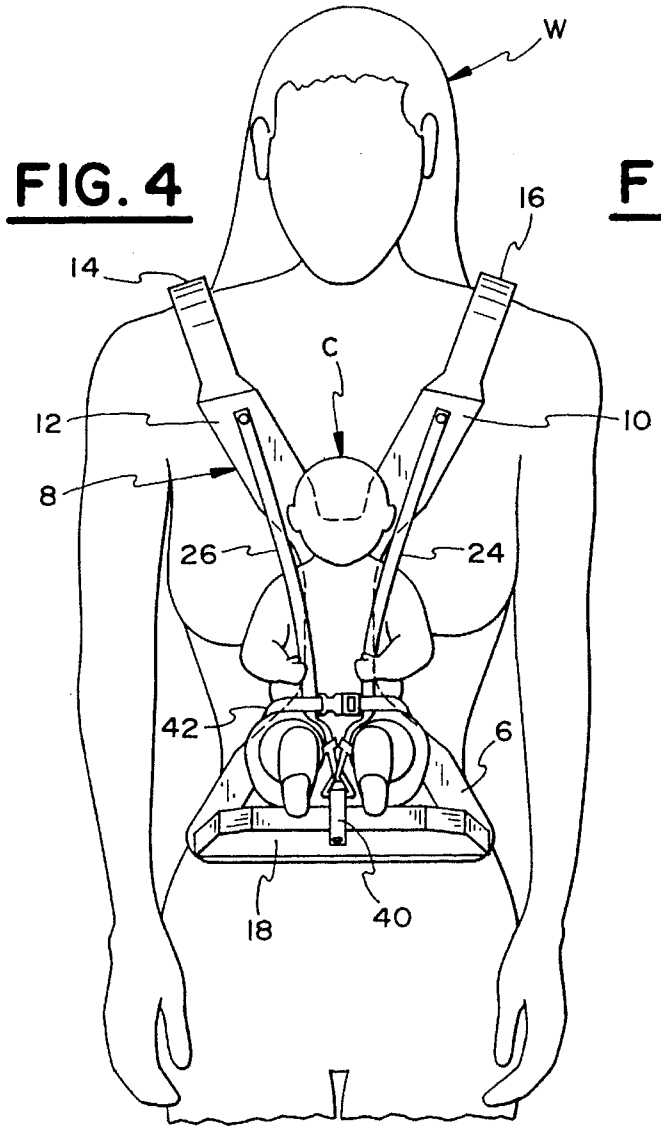
FIG. 4 illustrates a front plan view of the device shown in FIG. 1 secured to the upper torso of a wearer with a small infant seated therein.

Referring now to FIGS. 4 and 5, the infant carrier device A according to the present invention is shown while being worn by wearer W with a small child or infant C positioned therein. As can be seen, when fully extended and disposed upon the wearer W, the infant carrier device A is positioned in front of and on the upper torso of the wearer W. The bifurcated shoulder support member 8 is centered over the wearers chest so that each of the arcuately shaped portions 14 and 16 rests upon a separate shoulder and to either side of the wearers head. An optional separate waist strap 46 extends from the lower end 6 of the support frame 2 and around the waist of the wearer W. As can be appreciated, the waist strap 46 prevents the carrier device A from swinging away from the users upper body as he or she bends over.

The small infant or child C is shown seated within the carrier device A and more particularly on seat member 18 which extends perpendicular to the support frame 2. Each of the shoulder harness straps 24 and 26 is secured to the seat strap 40 and a waist strap 42 to retain the infant or child C while carried in the forward facing position.

As is apparent from FIGS. 4 and 5, the construction of the carrier device A is such that when positioned upon a wearer W and especially a female wearer, the bifurcated shoulder support member 8 rests flush against the upper torso without unduly obstructing or restricting freedom of movement to the wearer's chest.

Figure 6:
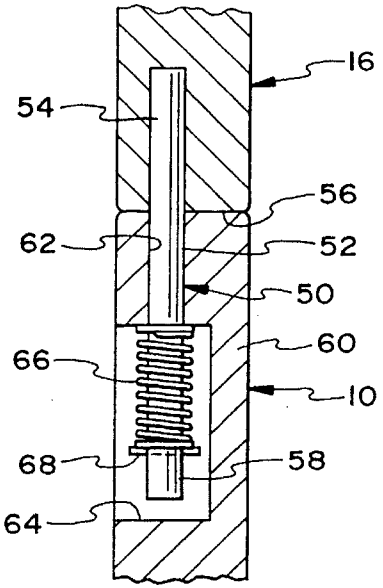
FIG. 6 is an enlarged cross-sectional view taken along lines 6—6 of FIG. 2 illustrating one of the elongated struts of the baby carrier with portions broken away and including details of the rotatable pin member.

Turning now to FIG. 6, the spring biased rotatable pin 50 is shown in greater detail. As can be seen, the rotatable pin 50 comprises a main body portion 52 provided with end 54 that extends into the end 56 of the arcuate shaped portion 16. The pin end 54 of the main body portion 52 is rigidly secured to arcuate shaped portion 16.

The opposite end 58 of the main pin body portion 52 extends into the end portion 60 of elongated strut 10. Opposite end 58 extends though a shaft 62 of end portion 60 and into recess 64. Pin 50 is freely rotatable and axially slidable within shaft 62. A spring member 66 is positioned about the opposite end 58 of main pin body portion 52 and is held in place by abutment 68 extending around the opposite end 58 of the main pin body portion 52.

The size of the spring 66 is selected so that when an infant or child is placed within carrier device A, the child's weight will be insufficient to overcome the force of the spring causing inadvertent disengagment of the arcuately shaped portion 16 from the elongated strut 10. However, disengagement can be achieved by manually manipulating the arcuate portions to cause folding as will be further explained below. As can be appreciated, a similar type device is also provided for a separate main pin body portion 52 disposed within and interlinking the arcuately shaped portion 14 and elongated strut 12. It is also within the scope of the present invention to provide other means of connection than the disclosed spring biased rotatable pin 50 so long as the means selected allows the arcuately shaped portions 14 and 16 to be freely rotatable from a locked position with their respective elongated struts 10 and 12.

Figure 7:
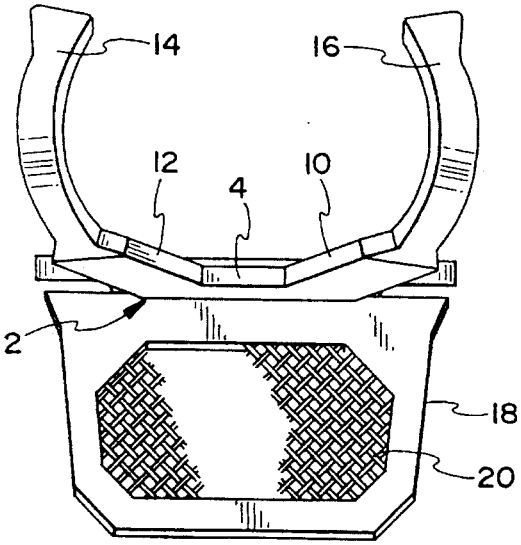
FIG. 7 illustrates a top plan view of the device shown in FIG. 2.
Figure 8:
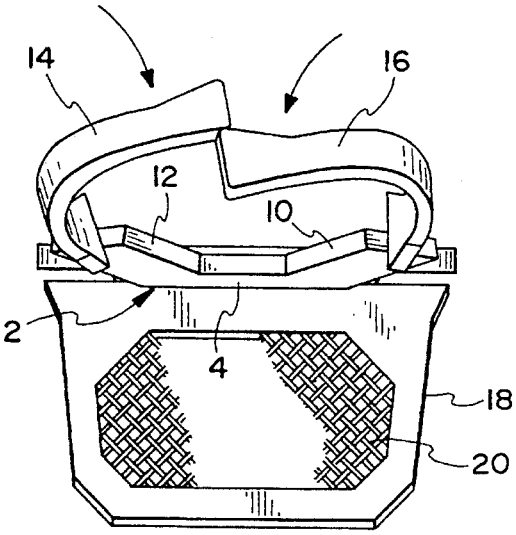
FIG. 8 illustrates a top plan view of the device shown in FIG. 2 and with the arcuate portions turned in the folded position.

Turning now to FIGS. 7 and 8, arcuately shaped portions 14 and 16 can be seen in FIG. 7 in a protracted or locked position. As best shown in FIG. 8, each of the arcuately shaped portion 14 and 16 may be selectively retracted into a folded position by axially rotating in the direction of the arrows so that the portions 14 and 16 face one another. The force within spring 66 is such that once turned, the respective arcuately shaped portion 14 remain in the retracted, folded position.

Figure 9:
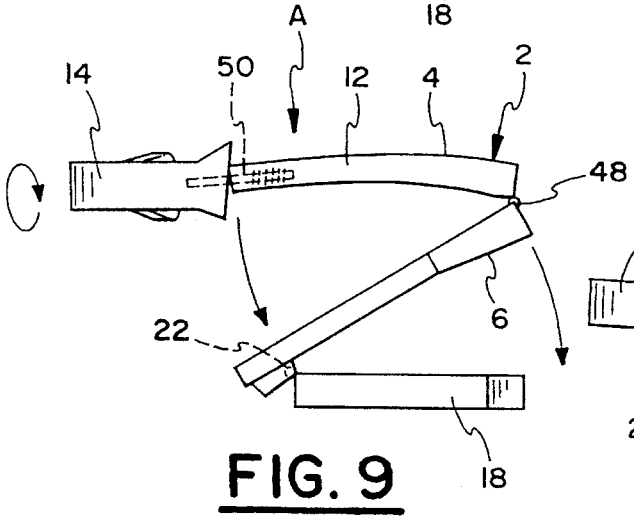
FIG. 9 illustrates a side view of the device shown in FIG. 8 in a partially folded position and including arrows to indicate direction of the various folds.
Figure 10:
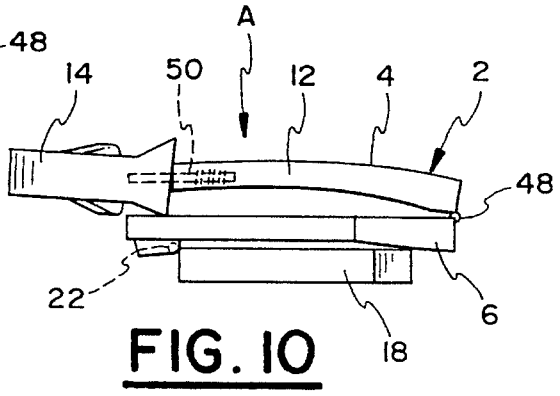
FIG. 10 illustrates the device shown in FIG. 9 when fully collapsed or folded.

Turning now to FIGS. 9 and 10, the infant carrier device A can be seen in partially and fully collapsed positions. As best shown in FIG. 9, the arcuately shaped portion 14 is rotated inwardly in the direction of the arrow (from the open position shown in FIG. 7) to its folded position while support frame 2 is folded about its hinge member 48 in the direction of the arrows with seat member 18 being folded in an opposite direction against the lower end 6 of support frame 2. As can be seen in FIG. 10, these movements result in a collapsed and fully folded carrier device A.

In a preferred embodiment the carrier device support frame 2 including the bifurcated shoulder support member 8 and seat member 18 are constructed from a lightweight alloy such as aluminum which provides high strength and low weight. However, it is within the scope of the present invention to construct the various frame members from materials other than aluminum and its alloys and in configurations which are other than rectangular in cross section. For example, the frame members may be constructed from rigid plastic and be substantially tubular in cross-sectional shape. Additionally, it is within the scope of the present invention to encase the various frame members within foam polyurethane or other cushioning material to provide added wearer comfort. Further, the hinge devices 22 and 48 are not restricted to those illustrated but may include any of a variety of flexible connectors known in the art to enable opposite members of a joint to articulate with respect to each other.

Figure 11:
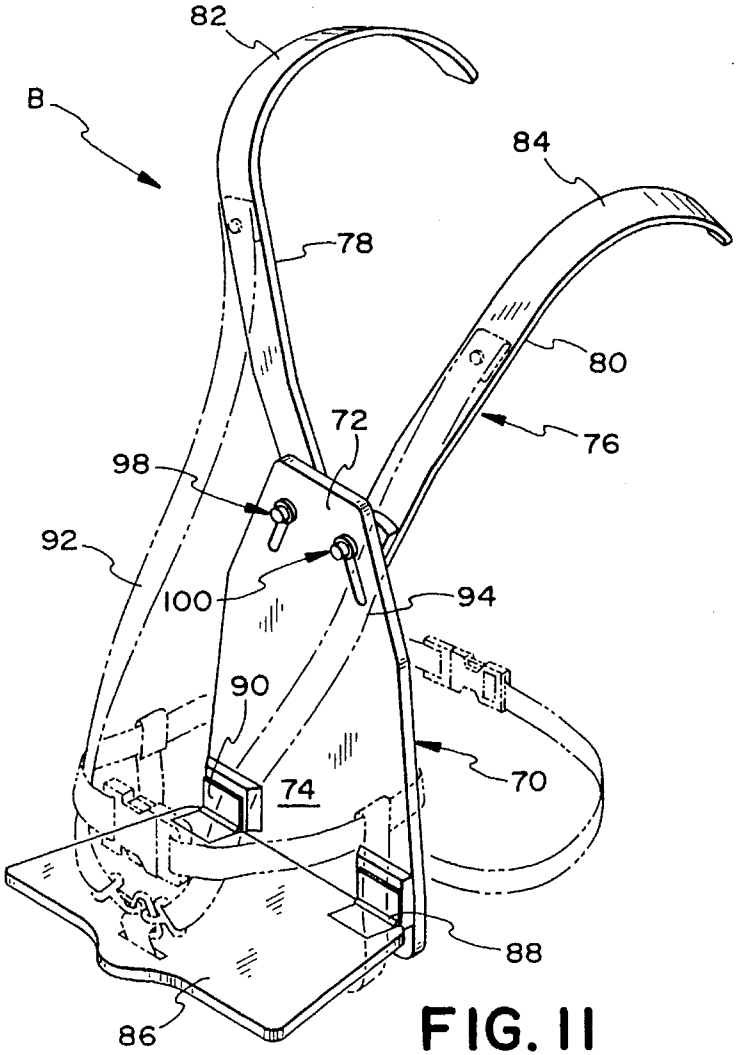
FIG. 11 illustrates a perspective view of another embodiment according to the present invention and with the harness straps shown in phantom lines.

Turning now to FIG. 11, an alternate embodiment according to the present invention is shown. The infant carrier device B includes a generally planar support frame 70 having an upper end 72 and lower end 74. A bifurcated shoulder support member 76 extends from the upper end 72 and includes a pair of separate elongated struts 78 and 80. Each of the elongated struts 78 and 80 include at their respective first ends a separate one of arcuate shaped portions 82 and 84. The elongated struts 78 and 80 are movably secured at their opposite second ends to the upper end 72 of support frame 70 via multi-pivot members 98 and 100. A separate one of multi-pivot members 98 and 100 are provided for each respective elongated strut 78 and 80 to pivotally secure the struts to the upper end 72 of support frame 70. A seat member 86 is secured to the lower end 74 of support frame 70 by hinge devices 88 and 90 or other means. Also provided are shoulder harness straps 92 and 94 as well as waist strap 96 all of which are shown in phantom lines.

Figure 16:
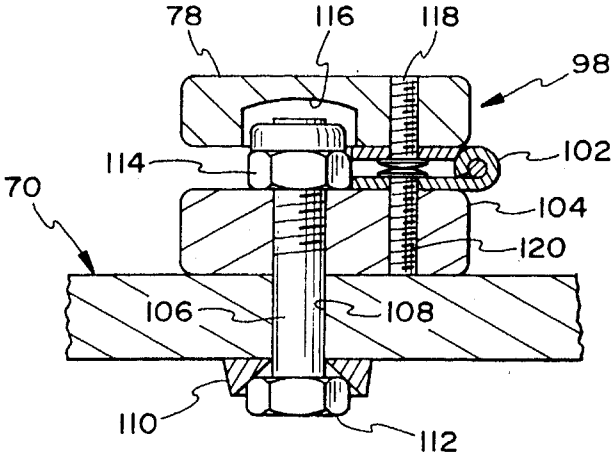
FIG. 16 illustrates an enlarged cross section view of a multi-pivot hinge according to the present invention taken along lines 16—16 of FIG. 12 with portions of the support frame broken away.

As best shown in FIG. 16, multi-pivot member 98 includes a hinge 102 that secures the end of elongated strut 78 to sliding block 104. Sliding block 104 is provided with a bolt or other means 106 received within slot 108 for sliding engagement along the length of the slot 108. A plastic washer or other means 110 may be provided underneath the head 112 of bolt 106 to reduce friction as the bolt 106 travels within slot 108. The opposite end of bolt means 106 is provided with a nut 114 to secure the sliding block 104 into sliding engagement against the support frame 70. Elongated strut 78 further includes a recessed portion 116 for accommodating nut 114 when the strut 78 is folded into engagement with the sliding block 104 as shown in the figure. The hinge 102 may be secured to the elongated strut 78 and sliding block 104 by screws 118 and 120 as shown or other means known in the art.

As can be appreciated, the other multi-pivot member 100 has a similar construction to that of pivot member 98 but supports a different elongated strut 80 and arcuate shaped portion 84. Each of the multi-pivot members 98 and 100 act as a fulcrum for their respective ,elongated struts 78 and 80 thereby allowing the strut to move between extended and folded positions. The pivoting fulcrum point of movement may be repositioned by sliding bolt within its respective slot. This feature allows each elongated strut of the bifurcated shoulder support member 76 to pivot in a downward position independent of the other remaining respective elongated strut.

Figure 17:
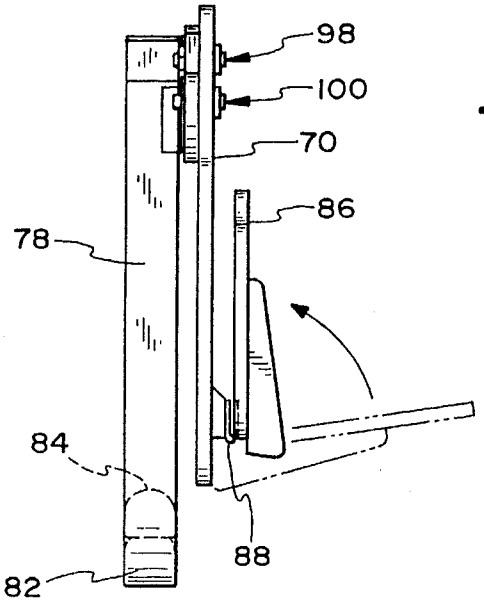
FIG. 17 illustrates a side view of the device shown in FIG. 15 when fully folded or collapsed and with the seat member shown in phantom lines in an open position.
Figure 13:
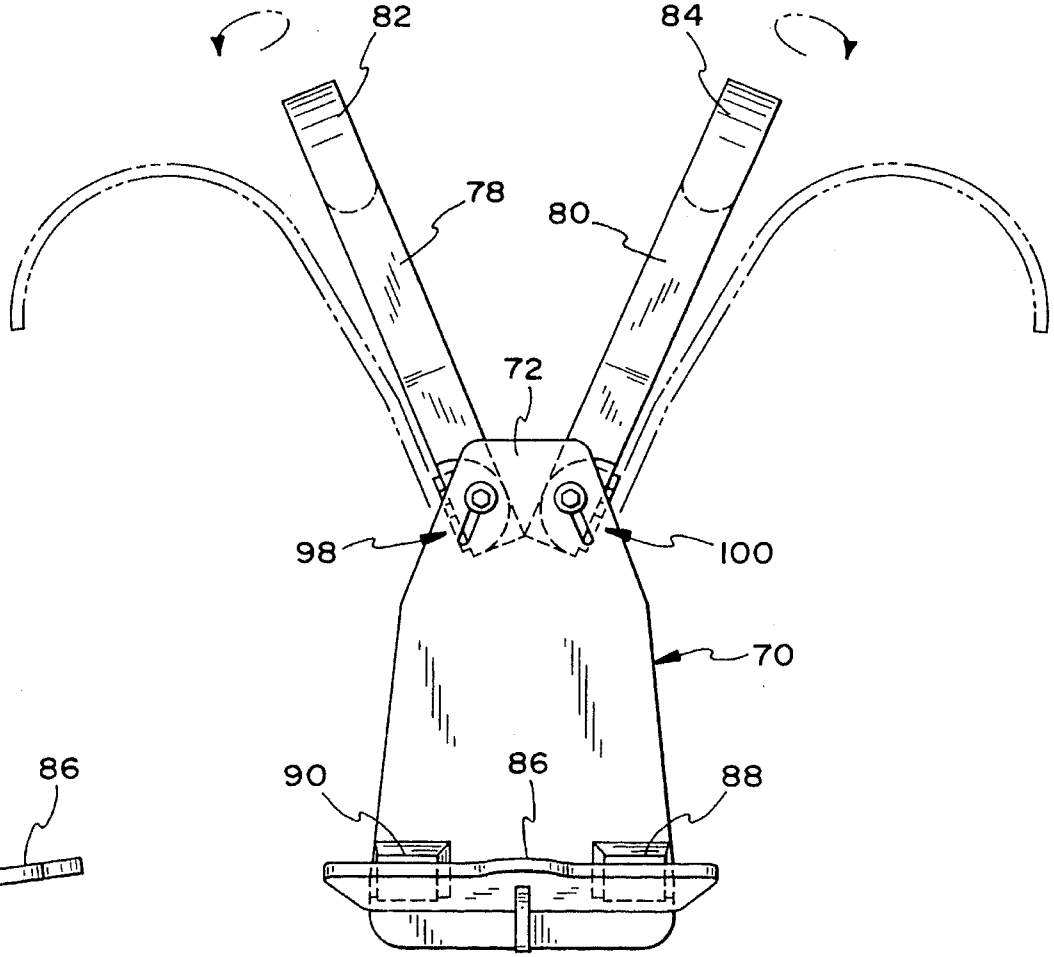
FIG. 13 illustrates a front view of the device shown in FIG. 12 with the rotated shoulder support members in phantom lines and including arrows to indicate direction of rotation.
Figure 12:
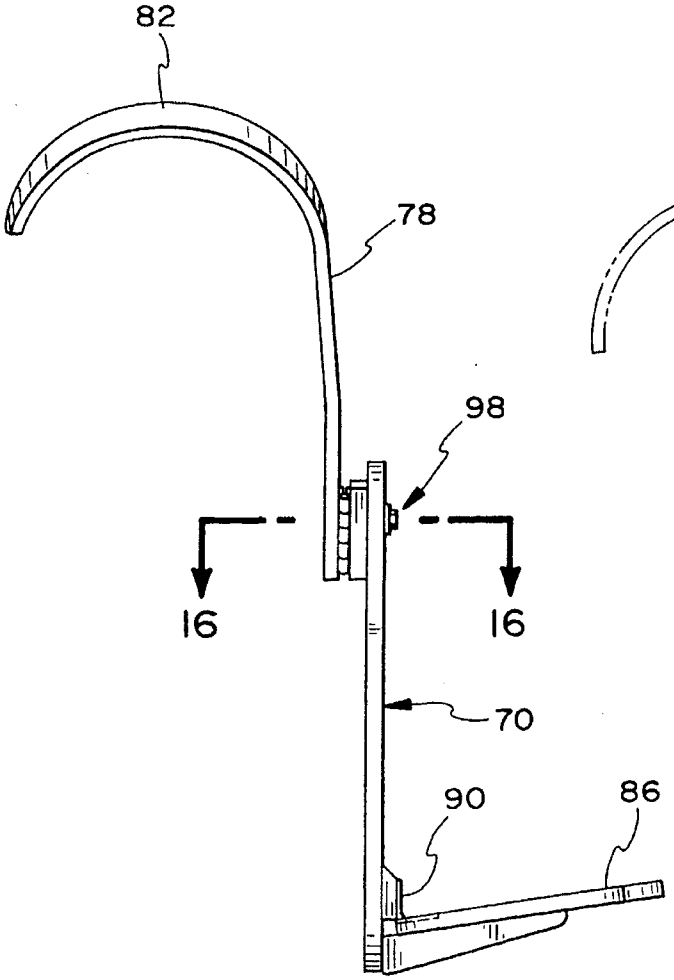
FIG. 12 illustrates a side view of the device shown in FIG. 11.
Figure 14:
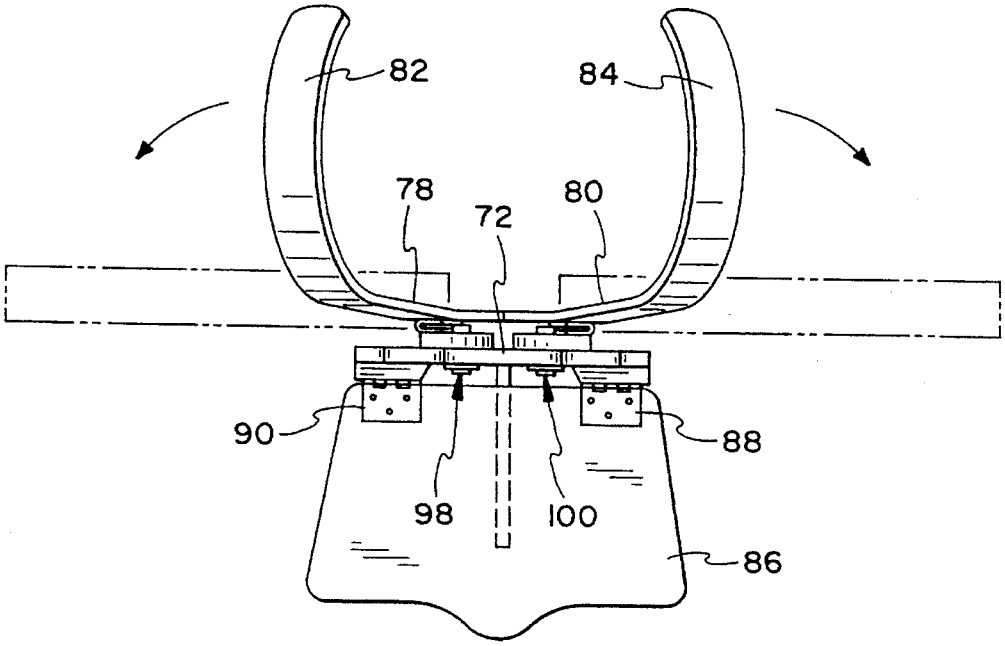
FIG. 14 illustrates a top plan view of the device shown in FIG. 13.
Figure 15:
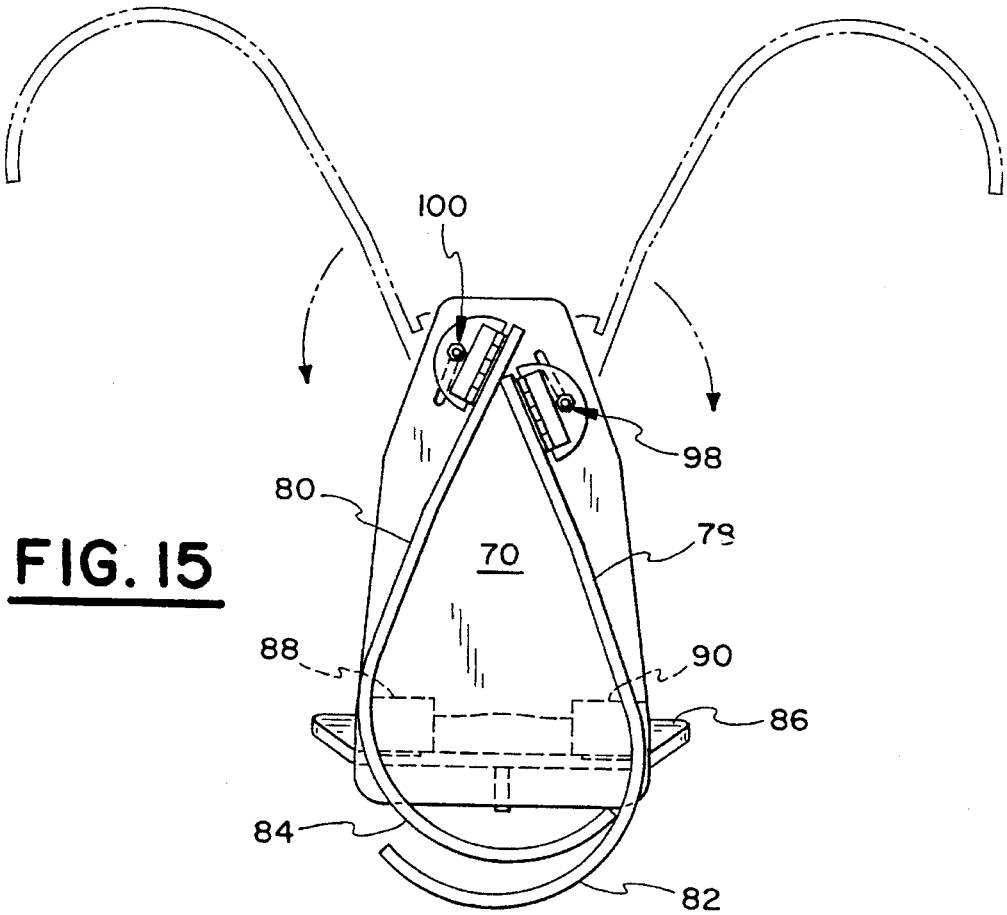
FIG. 15 illustrates a rear view of the device shown in FIG. 13 with the shoulder support members rotated into a fully collapsed position and showing the position of the shoulder support members prior to being fully collapsed in phantom lines with arrows to indicate direction of rotation and with portions of the seat shown in hidden lines.

The pivoting feature of the infant carrier device B is best illustrated by FIGS. 13 and 14 which sequentially depict struts 78 and 80 being first axially rotated about 45° from a protracted or in-use position to a partially folded position shown by phantom lines. As best shown in FIG. 15, each of the multi-pivot member 98 and 100 then enable the respective elongated struts to individually pivot around 150° from the position shown in phantom lines into the folded position against the back of frame 70. Generally speaking, the struts are rotated into the position shown in FIG. 15 one at a time. As best shown in FIG. 17, the infant carrier device B may then be collapsed into a fully folded position for storage or travel once the seat member 86 is folded against the support frame 70.

While this invention has been described as having a preferred designs, it is understood that it is capable of further modifications, uses and/or adaptations of the invention following in general the principle of the invention and including such departures from the present disclosure as come within the known or customary practice in the art to which to invention pertains and as may be applied to the central features hereinbefore set forth, and fall within the scope of the invention and of the limits of the appended claims.

What is claimed is:

1. An infant carrier device adapted to be worn on the upper torso of a wearer to position the infant in front of the wearer comprising:

a) a support frame having a first end, an opposite second end and a central member therebetween;

b) bifurcated shoulder support frame extending from said central member at said support frame first end to enable said carrier to be positioned about the upper torso of a wearer; and c) seat member secured to said support frame second end to receive and support an infant or small child.

2. A infant carrier device as set forth in claim 1 and further comprising;

a) cushion covering means for cushioning a user and infant from the device during use.

3. An infant carrier device as is claim 1 and wherein:

a) said bifurcated shoulder support frame comprising a pair of juxtaposed elongated struts, each individual strut of said pair of elongated struts having a first end and an opposite second end, each of said first ends provided with a respective arcuately shaped portion adapted to be positioned upon an individual user's shoulders, said opposite second ends of each of said pair of struts extensibly coupled to said support frame first end.

4. An infant carrier device as in claim 3 and wherein:

a) said seat member extends in an opposite direction from said arcuately shaped portions.

5. An infant carrier device as in claim 3 and wherein:

a) said seat member is pivotally connected to said support frame to allow said seat member to fold against said support frame into a closed position from a perpendicular open position.

6. An infant carrier device as in claim 5 and wherein:

a) said support frame including a hinge member positioned between said first and second ends to allow said frame to be folded from an extended position into a collapsed position.

7. An infant carrier device as set forth is claim 6 and wherein;

a) said seat member folds in an opposite direction from said frame member.

8. An infant carrier device as in claim 3 and wherein:

a) each of said arcuately shaped portions is pivotally connected to a respective one of said elongated strut first ends to allow said portions to be selectively protracted into an open position and retracted into a folded position.

9. An infant carrier device as in claim 8 and wherein:

a) said arcuately shaped portions are positioned parallel along their longitudinal axis when said carrier is to be worn by an individual.

10. An infant carrier device as in claim 8 and wherein:

a) said arcuately shaped portions are substantially aligned along their respective longitudinal axis and in a common plane when said carrier is in a folded position.

11. An infant carrier device as in claim 8 and wherein:

a) each of said arcuately shaped portions are extensibly coupled to said respective first ends of said elongated struts with a rotatable pin member extending therein and disposed colinear therebetween.

12. An infant carrier device as in claim 3 and wherein:

a) said arcuately shaped portions are fixedly secured to said respective first ends of said elongated struts.

13. An infant carrier device as in claim 12 and wherein:

a) each of said opposite second ends of said pair of struts is extensibly coupled to said support frame first end with a multi-pivot member to enable each of said elongated struts to rotate about their respective longitudinal axis thereby allowing selective protraction of said pair of struts into an open position and retraction into a folded position.

14. An infant carrier device as in claim 13 and wherein:

a) said arcuately shaped portions extend parallel along their longitudinal axis when said carrier is to be worn by an individual.

15. An infant carrier device as in claim 14 and wherein:

a) said arcuately shaped portions are substantially aligned along their respective longitudinal axis and in a common plane when said carrier is in a folded position.

16. An infant carrier device as in claim 13 and wherein:

a) said multi-pivot member including a sliding fulcrum member for allowing each of said pair of struts to pivot around 180 degrees within a horizontal plane between the protracted position and the retracted position; and b) said multi-pivot member further including an axial rotation member for allowing each of said pair of struts to rotate about its longitudinal axis.

17. An infant carrier device as in claim 16 and further comprising:

a) separate shoulder harness strap members releasibly secured at a first end to said bifurcated shoulder support member and at an opposite second end to said seat member; and b) waist strap means releasibly secured to said support frame.

18. An infant carrier device adapted to be worn on the upper torso of a wearer to position the infant in front of the wearer comprising:

a) a support frame having a generally X-shaped main body portion including a first end and an opposite second end;

b) bifurcated shoulder support members extending from said support frame first end to enable said carrier to be positioned about the upper torso of a wearer; and c) seat member secured to said support frame second end to receive and support a infant or small child.

19. An infant carrier as set forth in claim 18 and wherein;

a) said bifurcated shoulder support members including a pair of arcuately shaped portions adapted to be positioned upon an individual user's shoulders.

20. An infant carrier device adapted to be worn on the upper torso of a wearer to position the infant in front of the wearer comprising:

a) a support frame having a first end and an opposite second end;

b) a bifurcated shoulder support frame extending from said support frame first end to enable said carrier to be positioned about the upper torso of a wearer;

c) said support frame and said bifurcated shoulder support frame having a generally Y-shaped configuration; and d) seat member secured to said support frame second end to receive and support an infant or small child.

* * * * *